US005575090A

United States Patent [19]

Condini

[11] Patent Number: 5,575,090

[45] Date of Patent: Nov. 19, 1996

[54] INNER BOOT TONGUE OF A SKI BOOT

[75] Inventor: Alessandro Condini, Villazzano-Trento, Italy

[73] Assignee: Lange International S.A., Fribourg, Switzerland

[21] Appl. No.: 601,818

[22] Filed: Feb. 15, 1996

Related U.S. Application Data

[63] Continuation of Ser. No. 280,788, Jul. 26, 1994, abandoned.

[30] Foreign Application Priority Data

Sep. 7, 1993 [CH] Switzerland ..... 2 657/93

[51] Int. Cl.[6] ..... A43B 23/26

[52] U.S. Cl. ..... 36/54; 36/93; 36/71

[58] Field of Search ..... 36/54, 55, 93, 36/88, 91, 92, 90, 119, 10, 71, 3 R, 3 A, 3 B, 28, 29, 45, 115, 131, 72 R, 77 R, 77 M

[56] References Cited

U.S. PATENT DOCUMENTS

| | | | |
|---|---|---|---|
| 532,429 | 1/1895 | Rogers | 36/28 |
| 1,832,866 | 11/1931 | Johnson | 36/72 R X |
| 3,191,321 | 6/1965 | Brutting | 36/72 R X |
| 3,217,430 | 11/1965 | Novick | 36/72 R |
| 3,334,427 | 8/1967 | Edwards | 36/72 R |
| 3,974,578 | 8/1976 | Oettinger et al. | 36/72 R |
| 3,995,382 | 12/1976 | Smith | 36/72 R |
| 4,179,826 | 12/1979 | Davidson | 36/71 X |
| 4,333,248 | 6/1982 | Samuels | 36/72 R |
| 4,458,429 | 7/1984 | Schmid | 36/54 X |
| 4,534,122 | 8/1985 | MacPhail | 36/88 |
| 5,050,319 | 9/1991 | Perotto et al. | 36/55 X |

FOREIGN PATENT DOCUMENTS

| | | | |
|---|---|---|---|
| 0370948 | 5/1990 | European Pat. Off. . | |
| 0468532 | 1/1992 | European Pat. Off. . | |
| 2586342 | 8/1985 | France . | |
| 2594304 | 8/1987 | France . | |
| 1921508 | 10/1970 | Germany | 36/54 |
| 0654467 | 2/1986 | Switzerland | 36/10 |
| 1753415 | 4/1930 | United Kingdom | 36/54 |
| 0511324 | 8/1938 | United Kingdom | 36/72 R |

OTHER PUBLICATIONS

Search Report of Counterpart Swiss Application No. 2657/93.

*Primary Examiner*—Ted Kavanaugh
*Attorney, Agent, or Firm*—Kane, Dalsimer, Sullivan, Kurucz, Levy, Eisele and Richard LLP

[57] ABSTRACT

The part of a boot in question, in particular an inner-boot tongue of a ski boot, is essentially constituted by an outer part (1) made of impermeable semi-rigid plastic having an alveolate structure (6), covered directly by a foam-type padding (4) and by a woven or knitted liner (5). The air contained in the alveoles of the alveolate structure forms a particularly effective damper cushion in dynamic compression.

7 Claims, 4 Drawing Sheets

FIG. 1
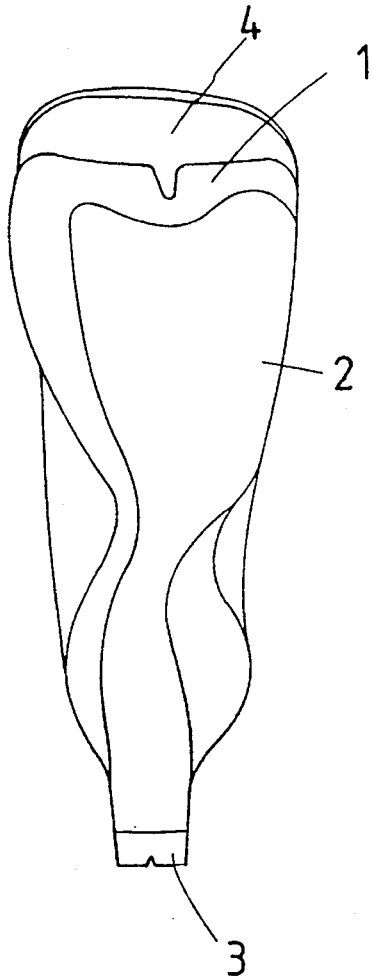
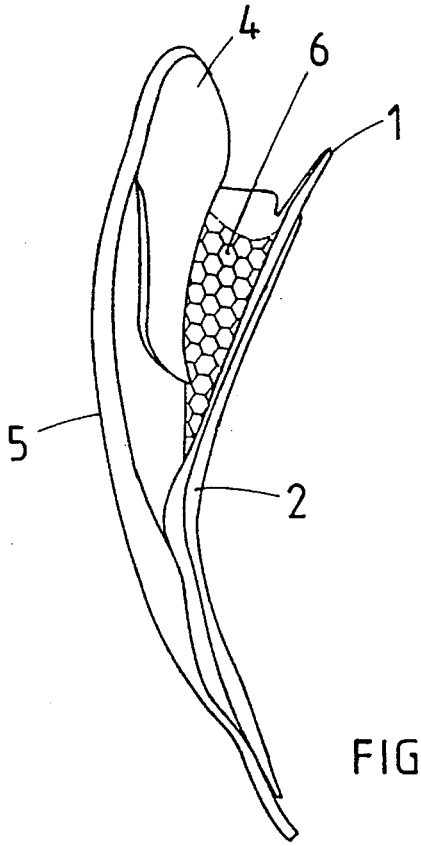
FIG. 2
FIG. 3
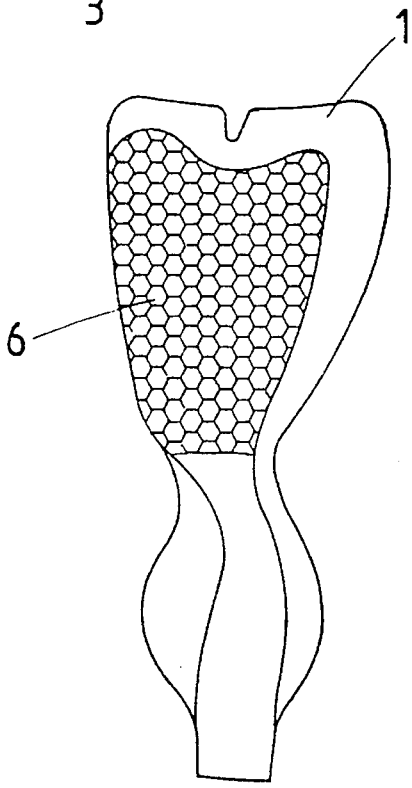

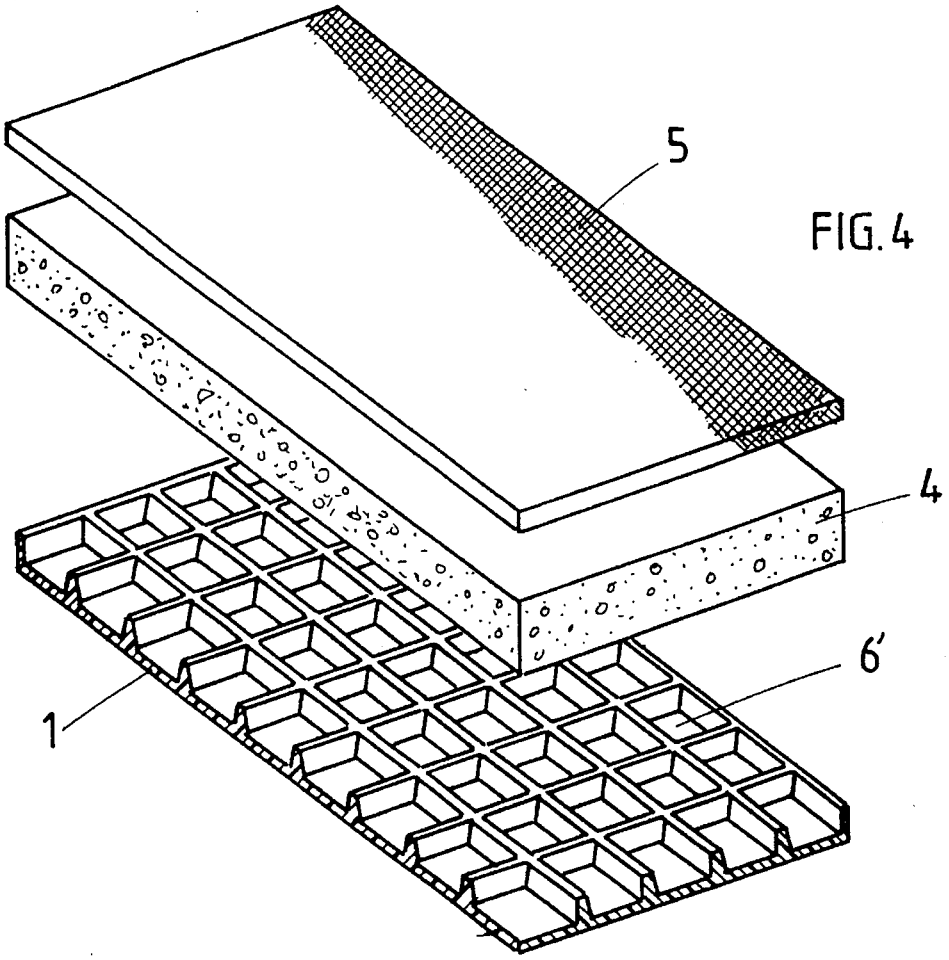
FIG. 4
FIG. 5
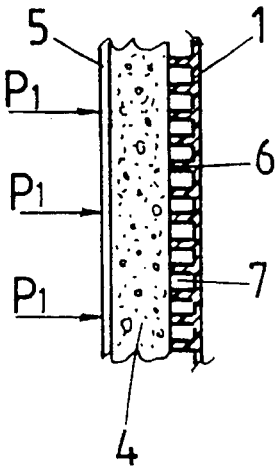
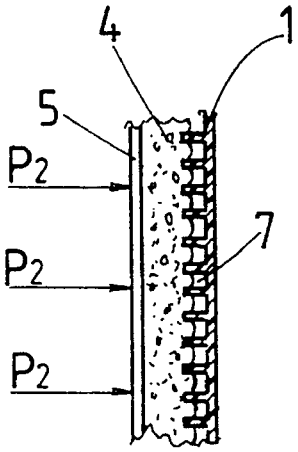
FIG. 6
FIG. 7
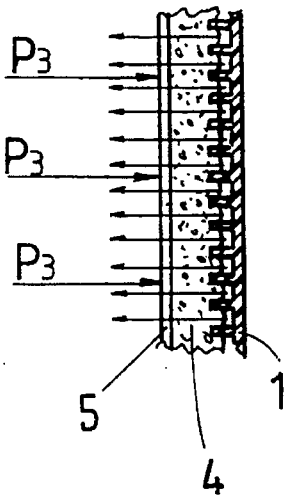

INNER BOOT TONGUE OF A SKI BOOT

This application is a continuation of application Ser. No. 08/280,788, filed Jul. 26, 1994, now abandoned.

FIELD OF THE INVENTION

The subject of the present invention is part of a boot, other than the sole, in particular an inner-boot tongue for a ski boot, essentially constituted by an outer part made of impermeable semi-rigid plastic, by a foam-type padding and by a woven or knitted liner.

PRIOR ART

Such tongues are commonly used in inner boots of ski boots. The outer part is intended to support the pressure of the boot-clamping buckles, the role of the foam being to ensure that the pressure exerted by the buckles does not result in a painful localized pressure. However, good holding of the foot in the boot requires relatively high clamping of the buckles and the skier often has the impression of a hard spot on the tibia despite the presence of the foam. This feeling of a hard spot, which may become painful, is due in fact to crushing of the foam. It turns out that even if this foam is not completely crushed statically by the buckle, it is totally crushed, in a repetitive and instantaneous way, in dynamic mode, by the repeated flexing of the leg, when the skier is skiing.

The tongue described in the document CH-A-677,588 has, in addition to the foam, a thick soft nonwoven textile layer. This layer, which substantially increases the thickness of the tongue, also ends up by being totally crushed by the action of the boot buckles.

A tongue is known, from the document EP-A-0,468,532, which comprises a pocket fitted between two foam layers, this pocket being filled with a liquid having a particular viscosity and mixed with solid particles, this mixture being commercially available under the FLOLITE trademark. Such a material has the advantage of ensuring that the shape of the tongue matches the shape of the tibia, but once it has adopted this shape, it does not act as a damper given the incompressibility of the liquid. Furthermore, if this material acts so as to distribute the pressure over the tibia, when working dynamically, its viscosity is such that it does not have time to flow under the pressure of the buckle and the skier again feels the localized pressure of this buckle.

It has already been envisaged to use a compressible fluid, that is to say a gas, in the manufacture of soles of sports shoes. Such shoes are described in, for example, the U.S. Pat. Nos. 4,183,156 and 4,219,945. The gas is contained under pressure in a multiplicity of mutually communicating chambers. This structure is intended to damp shocks while still ensuring a certain elastic response. Now, it is known that synthetic materials are not perfectly impermeable to gas, so that such a structure requires the use of special synthetic materials and the choice of a suitable gas, so as to maintain a sufficient pressure for several years. The use of such a structure for parts of boots other than the sole, in particular tongues, as proposed in the Patent FR 2,586,342, therefore has no real advantage, especially as the compression conditions are not comparable to that of a shoe sole as regards the magnitude of the permanent pressure and the pressure points.

SUMMARY OF THE INVENTION

The object of the present invention is to produce, as simply as possible, part of a boot, other than the sole, ensuring good damping, that is to say the absorption of an instantaneous overpressure due to a shock or to a boot-tightening means working dynamically during the flexing of the leg. The said part must also ensure that the foot is comfortable under static pressure by means of a good distribution of the external pressure.

In order to achieve this result, the part of a boot, according to the invention, is characterized in that the inner face of the outer part of the tongue has an alveolate structure covered directly by the padding.

The alveolate structure may, for example, be of the goffered or honeycomb type.

The foam is preferably an open-cell foam, but it could be a closed-cell foam.

The alveoles are closed by the padding foam, so that a certain quantity of air remains trapped in the alveoles. When clamping the boot, the foam penetrates only very slightly into the alveoles. The air trapped in the alveoles constitutes a cushion whose effect will be added to the effect of the foam, when working dynamically, that is to say during repeated flexing of the leg in the case of a tongue. During dynamic compression, this being added to the static clamping pressure, the foam in fact penetrates further, by deforming, into the alveoles and the air contained in the alveoles is compressed. The elasticity resulting from this compression has the effect of rapidly pushing back the foam out of the alveoles when the dynamic compression stops.

In the case of padding made of open-cell foam, the compressed air in the alveoles escapes through the foam and the inner liner. Given the very high pressure drop in the foam, the air, when working dynamically, does not, however, have the time to escape from the alveoles completely, so that part of this air remains in compressed form in the alveoles, the elasticity resulting from this compression also having the effect of rapidly pushing back the foam out of the alveoles when the dynamic compression stops.

Thus, contrary to the shock-absorbing soles of sports shoes, it is not necessary to have a gas-impermeable envelope. On the contrary, in the preferred embodiment, advantage is taken of the non-impermeability of the foam and of the liner. In addition, not only is the novel structure of the tongue produced without any additional element, but it makes it possible to dispense with the thick nonwoven textile layer present in the tongue according to the Patent CH 677,588.

BRIEF DESCRIPTION OF THE DRAWINGS

The appended drawing depicts one embodiment of the invention, as an example.

FIG. 1 is a view, from the outside, of a complete tongue.

FIG. 2 is a side view of the same tongue unstitched, the foam part of which having been partially separated from the plastic part.

FIG. 3 is a view just of the plastic part, seen from inside the inner boot.

FIG. 4 is an exploded diagrammatic view of part of the tongue with an alveolate structure different from that depicted in FIGS. 2 and 3.

FIGS. 5, 6 and 7 illustrate the behavior of the tongue during dynamic compression.

DESCRIPTION OF THE PREFERRED EMBODIMENT(S)

Figure 8:
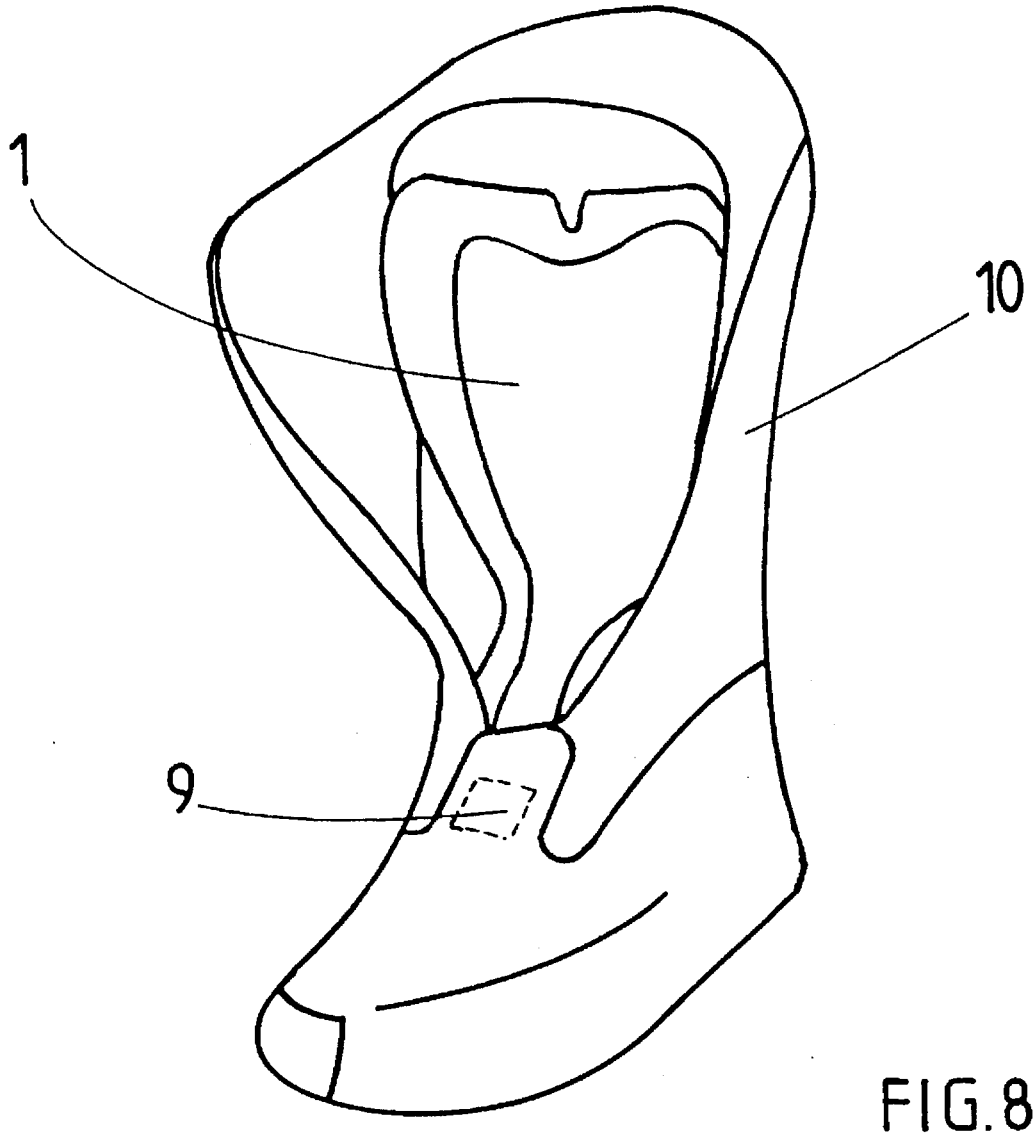
FIG. 8 depicts an inner boot equipped with a tongue according to FIG. 1.

The tongue depicted in FIG. 1 comprises a part 1 made of semi-rigid plastic, of curved shape in the form of a riding saddle, reinforced, in the embodiment depicted, by a plastic cover 2 partially covering the plastic part 1. The plastic part 1 is terminated, at its lower end, by a tab 3 equipped with a positioning notch for its attachment to a point 9 on the inner boot 10 depicted in FIG. 8. The inner side of the plastic part 1 is coated with a layer of open-cell foam 4 covered by a woven or knitted liner 5 stitched to the plastic part 1.

As may be seen in FIG. 2, the inner face of the plastic part 1 has a honeycomb alveolate structure 6.

The honeycomb structure 6 could be replaced by another alveolate structure, for example a goffered-type structure 6' such as depicted in FIG. 4 where, in exploded view, the layer of foam 4 and the liner 5 may also be seen.

The behavior of the structure of the tongue during dynamic compression will now be described in conjunction with FIGS. 5 to 7.

FIG. 5 depicts the state of the tongue at the beginning of compression when the pressure has only a value P1. The pressure P1 has the effect of compressing the liner 5 and, to a certain extent, the padding 4. This padding 4 bears against the end of the ribs formed by the alveolate structure 6. The air 7 contained in the alveoles of this alveolate structure has not yet been compressed.

FIG. 6 depicts the state of the tongue when the pressure has reached an intermediate value P2, which has the effect of compressing the padding 4 which deforms and penetrates into the alveoles 7 of the alveolate structure, compressing the air contained in these alveoles. It should be pointed out that the air contained in the padding 4 is also compressed.

FIG. 7 shows the tongue when the pressure has reached its maximum value P3, that is to say at the peak of the pressure pulse. During the compression phase, the compressed air in the alveoles 7 escapes slowly through the padding 4 and the liner 5. By reason of the very high pressure drop across the padding 4, which pressure drop is further increased by the compressed air in the open cells of this padding, the pressure of the air decreases relatively slowly in the alveoles. The pressure P generally disappears before the pressure of the air in the alveoles has been substantially decreased. Thus, until the end of the pressure pulse, the tongue maintains a certain quantity of compressed air, ensuring very high elasticity of the tongue to the compression and preventing any feeling of a hard spot at the point of a localized pressure on the tongue, which localized pressure is especially due to the boot-tightening means.

The state of the tongue, under static clamping compression, corresponds to the state depicted in FIG. 5 or to an intermediate state between the state depicted in FIG. 5 and the state depicted in FIG. 6, depending on the force with which the boot is clamped.

Figure 9:
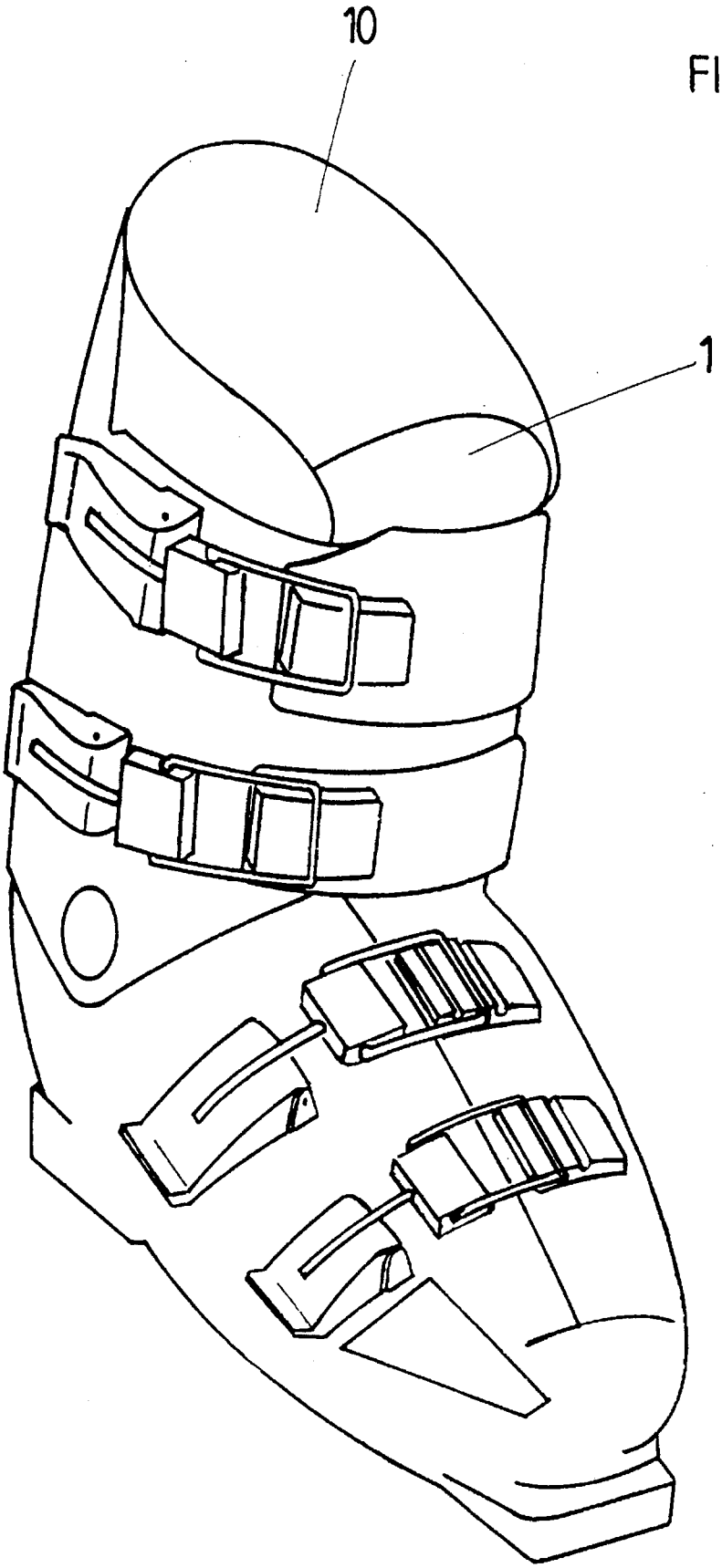
FIG. 9 is a schematic view of a generic ski boot incorporating the teachings of the present invention.

FIG. 9 shows a generic schematic drawing of a ski boot and the inner boot.

The structure according to the invention can be applied to any part of a boot or an inner boot, other than the sole, in particular the lateral parts level with the malleoli, or the tops and sides of the tarsal and metatarsal part.

The alveolate structure does not necessarily have to be regular, as depicted, but the alveoles could have a variable depth and shape. As regards the foam, this could be complex and, in particular, be constituted by foams of different densities and/or foams having open and closed cells.

I claim:

1. A ski boot containing an inner boot, said inner boot having a sole and an upper part and wherein said upper part has a padded part comprising;

an outer part which is made of impermeable semi-rigid plastic;

an alveolate structure on the inside of the outer part having alveoles hermetically closed on the outside by said outer part;

a foam-padding lying directly on the open side of the alveoles, so that the alveoles are taken in sandwich between said outer part and the foam-padding;

and an inner liner lying on the foam-padding, in such a manner that during dynamic compression of the padded part the foam penetrates further into the alveoles, compressing thereby the air trapped in said alveoles, so that instantaneous overpressures are damped.

2. A ski boot as claimed in claim 1, wherein the foam-type padding is an open-cell foam.

3. A ski boot as claimed in claim 1, wherein the padded part is a tongue.

4. A ski boot as claimed in claim 3, wherein the liner is made from a woven or knitted material.

5. A ski boot as claimed in claim 3, wherein the foam-type padding is an open-cell foam.

6. A ski boot as claimed in claim 1, wherein the alveolate structure has a honeycomb configuration.

7. A ski boot as claimed in claim 1, wherein the alveolate structure has a waffle configuration.

* * * * *